US009486066B2

(12) United States Patent
Bresselschmidt et al.

(10) Patent No.: US 9,486,066 B2
(45) Date of Patent: Nov. 8, 2016

(54) MANUAL TOOTHBRUSH CONCEPT BEING COMBINED FROM THREE PARTS

(71) Applicant: Braun GmbH, Kronberg (DE)

(72) Inventors: Andreas Bresselschmidt, Weiterstadt (DE); Andreas Birk, Kronberg/Taunus (DE); Holger Schulz, Frankfurt am Main (DE); Wolfgang Stegmann, Frankfurt am Main (DE); Jochen Ganninger, Eschborn (DE); Michael Jöst, Obertshausen (DE); Karl Herzog, Frankfurt am Main (DE); Andreas Reuschenbach, Bad Soden (DE)

(73) Assignee: THE GILLETTE COMPANY, Boston, MA (US)

( * ) Notice: Subject to any disclaimer, the term of this patent is extended or adjusted under 35 U.S.C. 154(b) by 0 days.

(21) Appl. No.: 14/273,277

(22) Filed: May 8, 2014

(65) Prior Publication Data

US 2014/0352091 A1 Dec. 4, 2014

(30) Foreign Application Priority Data

May 29, 2013 (EP) ..... 13169703
Sep. 5, 2013 (EP) ..... 13183143

(51) Int. Cl.
*A46B 9/04* (2006.01)
*A46B 15/00* (2006.01)
*A46B 5/00* (2006.01)

(52) U.S. Cl.
CPC ..... *A46B 15/0095* (2013.01); *A46B 5/007* (2013.01); *A46B 5/0054* (2013.01); *A46B 5/0095* (2013.01); *A46B 9/04* (2013.01); *A46B 5/002* (2013.01); *A46B 2200/1066* (2013.01)

(58) Field of Classification Search
CPC .... A46B 5/007; A46B 5/002; A46B 5/0062; A46B 5/0054; A46B 5/0029
USPC ..... 15/143.1, 144.1, 172
See application file for complete search history.

(56) References Cited

U.S. PATENT DOCUMENTS 759,490 A * 5/1904 Yates ..... 15/143.1
2,083,217 A * 6/1937 Brothers et al. ..... 15/167.1

(Continued)

FOREIGN PATENT DOCUMENTS

DE 102006005616 * 8/2007
DE 102006026165 * 12/2007

(Continued)

OTHER PUBLICATIONS

International Search Report and Written Report, mail date Jul. 25, 2014, 13 pages.

*Primary Examiner* — Michael Jennings
(74) *Attorney, Agent, or Firm* — James E. Oehlenschlager

(57) ABSTRACT

A toothbrush comprises a head, a neck portion and a handle, wherein the neck portion and the handle portion are connected to one another via a coupling element. The connection is constructed as an inseparable connection, i.e., after being combined once, the neck portion and the handle cannot be separated without the brush being destroyed by such separation. A method for producing such a toothbrush may comprise the following steps: providing a head, a neck portion, a handle, and a coupling element, and combining the neck portion to the handle by the coupling element so that an irreversible connection is formed.

20 Claims, 6 Drawing Sheets

(56) References Cited

U.S. PATENT DOCUMENTS

| | | | | |
|---|---|---|---|---|
| 4,654,922 | A * | 4/1987 | Chen | 15/172 |
| 5,054,154 | A * | 10/1991 | Schiffer et al. | 15/167.1 |
| 5,630,244 | A * | 5/1997 | Chang | 15/167.1 |
| 5,735,012 | A * | 4/1998 | Heinzelman et al. | 15/167.1 |
| 5,761,759 | A * | 6/1998 | Leversby et al. | 15/167.1 |
| 5,778,478 | A * | 7/1998 | Coleman | 15/167.1 |
| 5,903,949 | A * | 5/1999 | Halm | 15/167.1 |
| 6,101,659 | A * | 8/2000 | Halm | 15/167.1 |
| 6,292,973 | B1 * | 9/2001 | Moskovich et al. | 15/167.1 |
| 6,327,735 | B1 * | 12/2001 | Kramer | 15/167.1 |
| 6,353,958 | B2 * | 3/2002 | Weihrauch | 15/167.1 |
| 6,668,416 | B1 * | 12/2003 | Georgi et al. | 15/167.1 |
| 6,883,200 | B1 * | 4/2005 | Euler | 15/167.1 |
| 6,968,590 | B2 | 11/2005 | Ponzini | |
| 6,990,706 | B2 * | 1/2006 | Broecker et al. | 15/167.1 |
| 7,383,603 | B2 * | 6/2008 | Edwards | 15/185 |
| 7,937,794 | B2 * | 5/2011 | Huber et al. | 15/167.1 |
| 8,567,000 | B2 * | 10/2013 | Kubo | 15/206 |
| 8,763,196 | B2 * | 7/2014 | Kraemer | 15/167.1 |
| 2010/0313371 | A1 * | 12/2010 | Kaczmarek | 15/167.1 |
| 2011/0010874 | A1 | 1/2011 | Dickie | |
| 2011/0016651 | A1 * | 1/2011 | Piserchio | 15/167.1 |
| 2011/0067190 | A1 * | 3/2011 | Brattesani | 15/106 |
| 2012/0324664 | A1 * | 12/2012 | Carpenter | 15/143.1 |
| 2013/0247311 | A1 | 9/2013 | Dickie | |

FOREIGN PATENT DOCUMENTS

| | | | |
|---|---|---|---|
| DE | 102006026165 | A1 | 12/2007 |
| EP | 602611 | B1 | 9/1996 |
| FR | 2834188 | A1 | 7/2003 |
| WO | WO2008017996 | A2 | 2/2008 |

* cited by examiner

MANUAL TOOTHBRUSH CONCEPT BEING COMBINED FROM THREE PARTS

FIELD OF THE INVENTION

There is provided a toothbrush concept, in particular a manual toothbrush concept. The toothbrushes produced according to said concept comprise at least a head, a neck portion and a handle, wherein the neck portion and the handle are connected to each other inseparably using a coupling element. The different parts of the toothbrush may be produced by the known standard methods.

BACKGROUND OF THE INVENTION

Manual toothbrushes are constructed as disposable articles. Latest after three month of use a manual toothbrush shall be replaced at least due to hygienic reasons. That means that consumer generally only expect a low pricing for manual toothbrushes. On the other hand, manual toothbrushes have to meet a lot of requirements, such as complex bristle fields in order to clean properly interdentally, the gum line as well as the back molar teeth. Further, a manual toothbrush has to be smooth to the gum and comfortable to handle. Thus, there is a continuous need for the manufacturer of manual toothbrushes to optimize production processes in order to work very cost effective. One problem of the manufacturing of manual toothbrushes is the production time. Speed reducing steps are the cooling times needed if injection molding is used and the complexity of the bristle fields. The latter requires a lot of successive steps, if anchor technology is used to fasten the bristle filaments to the brush head. In contrast, anchor-free bristling technologies further improve the complexity of the molding procedure which as a consequence increases the molding time.

Two different solutions to this problem have been offered mainly over the last years. The most pragmatic one is to offer low price and high price products wherein in low price products complexity of the whole brush, in particular the bristle field is reduced. However, usually the low price products show a worse cleaning.

Alternatively, it was disclosed to adapt the reuse system of electric toothbrushes which comprises a reusable handle and a disposable replacement brush head to the field of manual toothbrushes. Due to differences between manual and electric toothbrushes a direct adaptation of the system does not make any sense. For example, replacement brush heads of electric toothbrushes comprise the receiving cavity in the replacement brush head and the coupling element at the electric handle. However, the receiving element requires a large diameter of the neck portion. In addition, due to stability reasons the neck portions of replacement brush heads are made from very hard plastic material to impart a high rigidity and strength to the replacement brush head during use. This approach is impractical for manual brushes as the neck portion of manual brushes needs to be small and at least partially flexible for a comfortable and proper cleaning and handling.

EP1284618B1 shows manual toothbrushes comprising a replacement brush head wherein the coupling element is provided by the brush head and the receiving element is provided by the handle. Said manual toothbrush is reversible dividable between the neck and the handle and can be remounted by a snap-fit connection. The snap and fit connection comprises flexible working portions and locating elements which engage into a receiving portion comprising a deformable elastic mass. However, these kind of snap-fit connections are difficult to produce and may wear out over time.

In addition, the split in dividable manual toothbrush may cause additional problems regarding hygienic use. Rests of paste, saliva and/or bacteria may enter the split or may stick to any edge, if the dividable portion is not sealed completely. EP0602611B1 offers another dividable manual brush comprising a swivel joint which is sealed by a pressure elastic material at the split portion. However, an elastic sealing of the split increases the complexity of the manufacturing process thereby increasing the production costs.

It seems that providing replaceable brush head for manual toothbrushes does not solve the initially discussed problem, but provides an alternative high price and complex product. Thus, there is still a need of providing high quality manual toothbrushes showing a high degree of complexity, quality and variability being produced by low costs.

SUMMARY OF THE INVENTION

In accordance with one aspect, there is provided a toothbrush comprising a head comprising one or more cleaning elements, a handle and a neck portion being connected to the head and a coupling element and being irreversibly mounted onto the coupling element, wherein a part of the coupling element protrudes from the coupling end of the neck portion, wherein the handle comprises a receiving end comprising a receiving element suitable to receive the part of the coupling element which protrudes from the coupling end of the neck portion and wherein the neck portion and the handle are arranged irreversibly onto the coupling element in such that the neck portion and the handle cannot be separated from the coupling element and cannot be separated from each other without destroying the toothbrush.

In accordance with another aspect, there is provided a kit for producing a toothbrush as disclosed herein, the kit comprising the head together with the neck portion providing the coupling end which is irreversibly mounted onto the coupling element, the handle providing the receiving end, and instructions how to form the one-time and irreversible connection of the coupling end of the head together with the neck portion and the receiving end of the handle.

BRIEF DESCRIPTION OF DRAWINGS

These and other features will become apparent not only from the claims but also from the following description and the drawings, with the aid of which example embodiments are explained below.

FIG. 4C shows another example of a toothbrush 10 comprising a coupling element 20 which functions as a hinge, wherein the coupling element 20 comprises two arms 22A, 22B and a pressure sensor 44 placed in-between.

DETAILED DESCRIPTION OF THE INVENTION

Figure 1A:
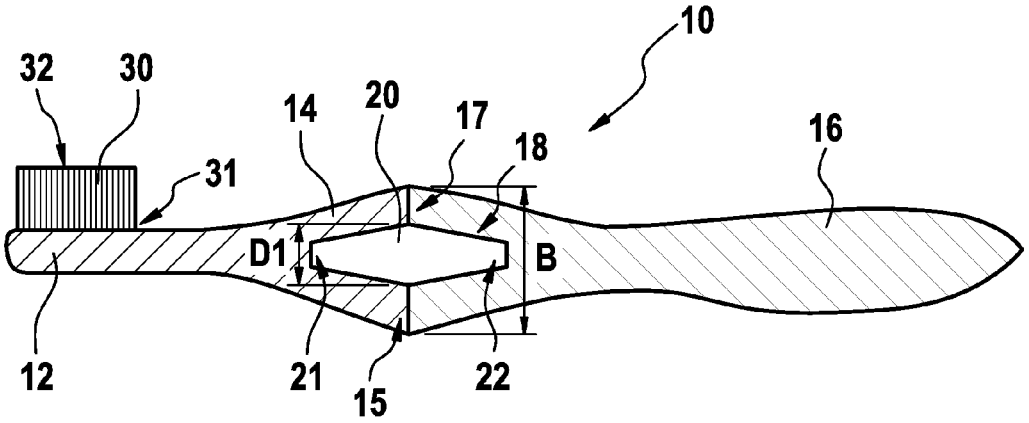
FIG. 1A shows a an example of a toothbrush 10 comprising a head 12, a handle 16 and a neck portion 14 being connected to the head 12 by a coupling element 20.

The following is a description of numerous versions of a toothbrush, in particular of a manual toothbrush. The description further discloses a method which can be used to produce the toothbrush as described herein. The description is to be construed as exemplary only and does not describe every possible embodiment since describing every possible embodiment would be impractical, if not impossible, and it will be understood that any feature, characteristic, structure, component, step or methodology described herein can be deleted, combined with or substituted for, in whole or in part, any other feature, characteristic, structure, component, product step or methodology described herein.

According to one aspect there is provided a toothbrush. Said toothbrush may be a manual toothbrush. Said toothbrush comprises a head, a handle and a neck portion which is connected to the head. In the head one or more cleaning elements are arranged in such that the ends of the cleaning elements which are intended to come into contact with teeth in order to clean them protrude from one side of the head. The neck portion comprises a coupling end which can be connected to the handle. Said coupling end of the neck portion comprises a coupling element which protrudes from the neck portion.

A "coupling element" as understood herein shall mean any geometric body which is suitable to one-time connects a neck portion and a handle irreversibly to each other. "One-time" connection as understood herein shall mean a connection which is intended to be connected once and is not intended to be separated and/or re-connected. That means an "irreversible" and "inseparable" connection as understood herein is a connection that is build once and cannot be separated again without destroying the connection as well as the connected pieces. That means, in particular, if an irreversible and/or inseparable connection as understood herein is separated after being formed the coupling element, the coupling end, the receiving end, the neck portion and/or the handle portion are destroyed.

As coupling element, for example, any pin, ball, hook, arm, plug, joint part, grappler or any other three dimensional protrusion from the neck portion can be used. Generally, the outer shape of the coupling element is determined by the outer shape of the neck portion and the handle portion. Preferably, the outer shape of the coupling element corresponds mainly to the outer shape of the neck portion and/or the handle portion, but is less complex. That results in an easier manufacturing of the coupling element. In addition, the maximum extension of the coupling element is also determined by the maximum extension of the neck portion and the handle. Preferably, the extension of the coupling element is smaller than the extension of the neck portion and the handle so that the outer shape and design of the neck portion and the handle can be formed independently from the outer shape of the coupling element.

For example, the coupling element may be a cylindrically or conically shaped body comprising a first end protruding into the neck portion and a second end protruding into the handle after forming the resulting toothbrush. That means the coupling element protrudes from the neck portion. "Protrusion" from the neck portion as understood herein shall mean any significant deviation from the regular outline of the neck portion including the coupling end. Said coupling element comprises a diameter which may be smaller or identical to the diameter of the toothbrush at the connection between the neck portion and the handle. In addition or alternatively, the diameter of the coupling element may be constant or may decrease or increase towards the ends of the coupling element. If the diameter increases the connection can only be formed by forming the neck portion and/or the handle directly on the coupling element. The direct manufacturing and the increase in the diameter of the coupling element result to a very strong, connection between the neck portion and the handle. If the diameter decreases towards the first and/or second end of the coupling element or is constant, the coupling element, the neck portion and the handle may be manufactured separately from each other and may be connected later on. In order to form a stable inseparable and irreversible connection additional security elements may be provided by the coupling element and/or the receiving element. "Security elements" as understood herein shall mean any element which secures and interlocks the connection between the head/neck portion and the handle. Suitable security elements may be for examples, snap-fits, engagement hooks, protrusions, undercuts and or combinations thereof.

All different variants may be also combined to each other. For example, the diameter of the coupling element may increase towards one end and decrease towards the other end or the diameter may increase or decrease towards one end and may be constant towards the other end.

The coupling end and the receiving end may show a common contact surface after the toothbrush is connected irreversibly, if the part of the coupling element protruding from the coupling end of the neck portion vanishes completely in the receiving end of the handle. Alternatively, the coupling element may comprise a circumferential elevation or collar which dimension is bigger than the dimension of the receiving end of the handle. The "circumferential elevation" or collar as understood herein shall mean the central portion of the coupling element being located at the contact surface between the coupling end of the neck portion and the receiving end of the handle thereby creating a space between the coupling end of the neck portion and the receiving end of the handle. Thus, due to the circumferential elevation the coupling end of the neck portion and the receiving end of the handle are spaced apart from each other forming a gap. Said gap may be filled partly or completely with the circumferential elevation itself. If the circumferential elevation does not fill the gap between the coupling end of the neck portion and the receiving end of the handle completely a sealing material may be used to fill the gap. Said sealing material may be a hard plastic material, an elastomeric material, a resin or any other material suitable to seal. If the circumferential elevation is made from an elastomeric material the circumferential elevation may act as a buffer between the neck portion and the handle. The circumferential elevation may be only the area of the contact surface or may be a bigger element having a thickness. The thickness of the circumferential elevation may be in the range of about 0.5 to about 5 mm, or in the range of about 0.5 to about 4 mm, or in the range of about 1 to about 3 mm, or in the range of about 1.5 to about 2.5 mm or any other numerical range which is narrower and which falls within such broader numerical range, as if such narrower numerical ranges were all expressly written herein. The circumferential elevation may be arranged perpendicular to the longitudinal axis of the brush or may be inclined to the longitudinal axis of the brush. For example the inclination angle to the longitudinal axis of the brush may be in the range of about 45° to about 85°, or in the range of about 55° to about 80°, or in the range of about 65° to about 75°, or any other numerical range which is narrower and which falls within such broader numerical range, as if such narrower numerical ranges were all expressly written herein.

The diameter of the circumferential elevation may be identical to the diameter of the coupling end of the neck portion and the receiving end of the handle. Alternatively, the diameter of the circumferential elevation may be smaller or bigger compared to the diameter of the coupling end of the neck portion and the receiving end of the handle. If these diameters are identical or the diameter of the circumferential elevation is bigger than the diameter of the neck portion and/or the handle the circumferential elevation of the coupling element is a visible element in the resulting toothbrush. That means the circumferential elevation forms a part of the outer surface of the toothbrush. Thereby the circumferential elevation may be used as a design element and/or as a functional element. For example, the circumferential elevation may inform the user about the brush properties or a bigger diameter of the circumferential elevation may be used to stop the fingers slipping in the direction of the head during the use of the toothbrush. If the diameter of the circumferential elevation is smaller than the diameter of the neck portion and the handle, the circumferential elevation will be covered by the material of the neck portion and/or the material of the handle. Alternatively, the circumferential elevation may be covered with an additional material in order to form a smooth and hygienic outer surface of the toothbrush. An internal, i.e. non-visible, circumferential elevation which is covered with the neck, handle and/or additional material may be used as an internal stabilizer against torsion or bending. The diameter of the coupling element may decrease rapidly or continuously towards the ends of the coupling element after the circumferential elevation. Alternatively, the diameter of the coupling element may decrease rapidly or continuously towards the ends of the coupling element including the area of the circumferential elevation. For example, the circumferential elevation may comprise a constant diameter, then the diameter may decrease rapidly and the remaining part of the coupling element may comprise a constant and/or a decreasing or increasing diameter.

The coupling element may be provided using injection molding, thus any material suitable to be processed by injection molding may be used to produce the coupling element. For example the coupling element may consist of a hard plastic material. Said hard plastic material may be a pure hard plastic material or a mixture of several hard plastic materials. Suitable hard plastic materials are for example, polyoxymethylene, polypropylene, polyethylene, polyethylene terephthalate or mixtures thereof. Producing the coupling element from a hard plastic material stabilizes the toothbrush in the most bent middle section. Thereby also expensive materials can be used as only the small coupling element has to be formed from the expensive material. The handle, head and the neck portion can be produced for example from a less expensive material. For example, the handle, head and the neck portion can be produced from polypropylene showing for example anti-adhesive properties with respect to any kind of dirt.

In addition or alternatively, the material of the coupling element may comprise a higher E-modulus than the material of the head and/or the material of the handle. If the coupling element is made from a material comprising a higher E-modulus than the material of the head and/or the handle the coupling element provides rigidity and stiffness to the brush, so that the handle cannot break through. Alternatively, the material of the coupling element may comprise a lower E-modulus than the material of the head and/or the material of the handle. If the coupling element is made from a material comprising a lower E-modulus than the material of the head and/or the handle the coupling element may show a further functionality, namely the coupling element may be used as a hinge so that the brush becomes bendable and flexible at the neck to handle connection. In particular, a thick circumferential elevation may allow the brush to be bent in the middle of the brush. The thickness of the thick circumferential elevation which shall provide a hinge function may be in the range of about 2 to about 20 mm, or in the range of about 5 to about 15 mm, or in the range of about 8 to about 13 mm, or in the range of about 10 to about 12 mm or any other numerical range which is narrower and which falls within such broader numerical range, as if such narrower numerical ranges were all expressly written herein. Thereby high pressure which is placed onto the teeth during use of the toothbrush may be compensated by the hinge function of the coupling element. Suitable materials which can be used for a coupling element showing an additional hinge function may be for example polypropylene, polyethylene, a thermoplastic elastomer or a mixture thereof. Thermoplastic elastomers which may be used to form the coupling element may show a Shore A hardness in the range of about 60 to about 110, or in the range of about 70 to about 100 or in the range of about 75 to about 90 or any other numerical range which is narrower and which falls within such broader numerical range, as if such narrower numerical ranges were all expressly written herein.

In addition or alternatively, the hinge function of the coupling element may be realized by a special combination of the materials of the handle and of the coupling element. For example, the coupling element may be formed form a hard plastic material and the handle of the toothbrush may be formed from a soft plastic material at least in the area of the coupling element. A force applied to the one or more cleaning elements may be transported via the coupling element into the elastomeric part of the handle. Thereby the elastomeric part of the handle is compressed. Said compression compensates the force applied at least partially. Said partial compensation of the force applied to the one or more cleaning elements will be helpful, if the user applies too much force during brushing. Brushing using too much force may hurt the gums as well as the teeth, so that it may be advantageous having a brush providing a compensation mechanism. The hardness of the elastomeric material of the handle may be adapted to the force applied which is critical for the gums and the teeth so that the compensation of the force only works with critical forces and the non-critical forces can be used completely for the brushing action. The compensation of force may be combined with a sensor alerting the user by a signal. The sensor may be introduced in the handle so that the coupling element will activate the sensor, if too much force is applied to the one or more cleaning elements. For example, the sensor may be incorporated into the elastomeric part of the handle. The signal may be any signal, such as acoustic signals, like tone signals, visual signals, like light signals or a vibration or a combination thereof.

The handle of the toothbrush comprises a receiving end comprising a receiving element which is suitable to receive the coupling element. That means that form and function of the receiving element are determined by form and function of the coupling element. For example, if the coupling element is a kind of a pin, the receiving element comprises at least a hollow space which is compatible to the coupling pin. In addition or alternatively, if the coupling element comprises a mechanical snapping element, the receiving element comprises the corresponding counterpart. Independently from the concrete design of the coupling element and the receiving element the connection of the coupling element and the receiving element is irreversible. That means after one neck portion is mounted via the coupling element to one handle, these parts of a toothbrush are mounted inseparably to each other.

In addition or alternatively, the receiving element may be an integral part of the handle or it may be a distinguishable part which is irreversibly connected to the handle. If the receiving element is an integral part of the handle, receiving element and handle consist of the same material. Example materials are given together with the description of the handle variants. If the receiving element is a distinguishable part, it may consist of the same or a different material than the handle. The material of the receiving element may be for example a hard plastic material or a soft plastic material. Suitable hard plastic materials are for example polyoxymethylene, polypropylene, polyethylene, polyethylene terephthalate or mixtures thereof. Soft plastic materials are for example a thermoplastic elastomer, in particular a thermoplastic elastomer having a Shore A hardness in the range of about 30 to about 90, or in the range of about 40 to about 80, or in the range of about 50 to about 70 or any other numerical range which is narrower and which falls within such broader numerical range, as if such narrower numerical ranges were all expressly written herein. Preferably, the material of the handle and the material of the receiving element are combined in that a chemical and/or molecular connection is formed between the two materials.

The handle may be of any shape suitable to be hold by the user. Geometric shape may be adapted to the user preferences according to cleaning behavior and toothbrush handling. The easiest shape of a handle may be an elongated pin. Said shape may be optimized according to curve and thickness. The handle may be produced from any material. For example the handle may be formed from plastic, metal, ceramic, glass, wood, such as bamboo, horn, ebonite etc. Suitable plastic materials are for example polyoxymethylene, polypropylene, polyethylene, polyethylene terephthalate, soft plastic materials or mixtures thereof. If the handle is manufactured from plastic, the handle may be produced by blow molding, injection molding or any other molding method. The surface of the handle may be further finished, for example by galvanization, polishing, roughening, applying a coating, applying a printing, applying a varnish or a combination thereof. In addition or alternatively, the handle may comprise elastomeric elements at the outline which may be used as design elements in order to improve the optical appearance of the handle and/or may be used as functional elements improving for example the haptic of the handle. The functional elements may improve the overall haptic of the handle or may provide grapping areas for the fingers.

In addition to providing the gripping area for handling the toothbrush, the handle may provide more functional properties. For example, the handle may compensate pressure applied to the teeth. If the user applies more than a critical pressure to toothbrush during brushing the gum, the gum lines or the teeth may be hurt by the cleaning elements. Said pressure may be partially compensated by the handle. For example, if the handle comprises an elastomeric part, the toothbrush may be bent elastically. For example, the part of the handle surrounding the coupling element may comprise or consist of a thermoplastic elastomer. Thereby, the coupling element can be pressed into the elastomeric material and the pressure is compensated partially. In addition or alternatively, the handle may comprise a sensor, in particular a pressure sensor. The sensor may be activated by the coupling element, if the toothbrush is used with more than a critical pressure. A critical pressure as understood herein may be any pressure by which the gum, the gum lines or the teeth may be hurt during brushing with the toothbrush. Said pressure may be transferred from the cleaning elements via the head and the neck portion to the coupling element which may activate the sensor. The sensor signal may be a light signal, a tone signal, a vibration or a combination thereof.

For the toothbrush as described herein any known cleaning elements may be used. Suitable cleaning elements are for example bristles, bristle tufts, elastomeric elements or combinations thereof. Bristles may be for example monofilaments made from plastic material. Suitable plastic material used for bristles may be polyamide (PA), polybutylterephthalate (PBT), polyethylterephthalate (PET) or mixtures thereof. Several bristles may be combined to form one bristle tuft. Suitable numbers of bristles to form one bristle tuft may be for example in the range of about 10 to about 80, or in the range of about 15 to about 60, or in the range of about 20 to about 50, or in the range of about 25 to about 40, or any other numerical range which is narrower and which falls within such broader numerical range, as if such narrower numerical ranges were all expressly written herein. Two or more bristle tufts may be combined in order to form one super tuft. One bristle tuft may consist of identical filaments or filaments of different material, different form, different length, different diameter, different end geometry or any other filament property. The filaments of one tuft may differ in more than one property. Several bristle tufts may be arranged in the head to form the cleaning elements.

In addition or alternatively, bristles or bristle tufts may be combined with elastomeric elements to form the cleaning elements. The elastomeric element may be, for example, a nub, a pin, a fin, a wall, a bar, a gutter, a curve, a circle, a textured element, a polishing element such as, for example, polishing cups or a tongue cleaning element or a combination thereof. Natural rubber, synthetic rubber, thermoplastic elastomers or a mixture thereof may be used as an elastomeric material to form the elastomeric elements. A "textured element" as used herein, refers to a structure that has a macroscopic surface texture. For example, the textured element may be composed of a cluster of ribs, fins, columns, or other protrusions, or a combination of ribs, fins, columns, or other protrusions, that together form a unitary structure. In addition or alternatively, the texture can be imparted to the member by a manufacturing process such as injection molding, by embedding particles in the surface of the member, or by selecting a material for the member that inherently has a surface texture, e.g. open cell foam.

The cleaning elements may be fastened to the head by any known method, for example by anchor tufting or anchorless tufting, such as hot tufting methods. In addition or alternatively, the cleaning elements may be mounted directly to the head or to a separate plate. Said separate plate may be mounted to the head by any known method such as ultrasonic or laser welding, injection molding, snap and fit etc. The plate may be provided first having holes into which the cleaning elements are placed. Alternatively, the plate may be manufactured by over-molding the cleaning elements which are provided by a cleaning element carrier with a plastic material. The plastic material of the plate may be identical or different to the material of the head.

The head may comprise any form suitable to be introduced into a mouth in order to clean the teeth. Suitable materials for the head may be hard or soft plastic materials, for example polyoxymethylene, polypropylene, polyethylene, polyethylene terephthalate, thermoplastic elastomers or mixtures thereof. In addition, plastic materials of different Shore A hardness may be combined. In addition to the cleaning elements, the head may comprise a tongue cleaner or any other oral cleaning implement.

The neck portion connects the head and the handle and comprises the coupling element. Head and neck portion may be one integral part. The neck portion may consist of the same material than the head. The neck portion may be of any geometric shape as long as its function of providing the coupling element persists. The surface of the head and/or the neck portion may be further finished, for example by galvanization, polishing or roughening, applying a coating, a printing, a varnish or a combination thereof.

According to another aspect there is provided a kit for forming the toothbrush as disclosed herein. The kit provides the head together with the neck providing the coupling end and the handle providing the receiving end separately. In addition the kit provides instructions how to connect the coupling end and the receiving end in order to form the toothbrush. The connection between the coupling end and the receiving end is one-time and irreversible. The head, neck and/or handle comprised in the kit may comprise all features disclosed herein whether described individually or in combination with respect to these parts of the toothbrush.

According to one aspect the toothbrush as described herein is achievable and producible by the method as described herein. In addition or alternatively, a toothbrush as described herein is achievable and producible by providing a coupling element, providing cleaning elements, providing a head and neck portion; mounting the cleaning elements to the head, connecting the head and the neck portion, if applicable, irreversibly mounting the coupling element to the coupling end of the neck portion; providing a handle comprising a receiving end and providing a receiving element and inseparably mounting the coupling element to the receiving element of the handle, whereby the neck portion and the handle are irreversibly connected to each other in order to form the toothbrush.

All different parts of the toothbrush may be provided separately from each other or in groups. For example, the head and the neck portion may be provided together, but the handle and the coupling element may be provided separately. In addition or alternatively, all parts, namely the head or a part of it, the neck portion, the coupling element and the handle may be provided separately. Providing one or more parts of the toothbrush as described herein may be performed simultaneously or successively. For example, the coupling element may be produced in one manufacturing step and the head comprising the neck portion and the handle are produced in parallel and all parts are connected to each other via the coupling element. If the neck portion and the coupling element are provided separately the coupling element is connected irreversibly to the coupling end of the neck portion. The irreversible connection between the coupling element and the neck portion may be performed simultaneously to or before or after the irreversible connection between the coupling element and the handle. In addition or alternatively, the neck portion and the coupling element may be produced together in one manufacturing step.

The irreversibly mounting can be performed by any possible method. For example, the irreversible connection is formed by a snap and fit connection, by over-molding, welding, ultrasonic combination, gluing or any other mechanical connection which cannot be separated without destroying the neck portion and/or the handle.

One method for connecting the neck portion and the handle to the coupling element may be injection molding. Thereby the coupling element may be over-molded by the neck portion and/or the handle. Alternatively, the coupling element may be connected to the neck portion and/or the handle via a snap and fit connection. If the coupling element is connected to the neck portion via injection molding, the neck portion and the head may be injected in one injection step. Thereby, the one or more cleaning elements may be over-molded at their ends to be mounted into the head so much that the ends intended to clean the teeth protrude from the head formed. In addition, the coupling element is over-molded at the area which is intended to be connected irreversibly to the neck portion so much that a second part of the coupling element which is intended to couple to the handle protrudes from the neck portion. In parallel or successively, a handle is provided which comprises a receiving element, wherein the receiving element is compatible to the part of the coupling element which protrudes from the neck portion. Finally, the toothbrush is produced by connecting the coupling element protruding from the neck portion and the receiving element of the handle, wherein said connection is inseparable so that the neck portion and the handle cannot be sub-divided again without destroying the toothbrush.

In addition or alternatively, several connection techniques may also be combined. For example, direct manufacturing and/or mounting of the neck portion and/or the handle portion onto the coupling element may be combined with a later mounting of the remaining part of toothbrush. For example, the neck portion may be mounted onto the coupling element by injection molding and the handle may be mounted to the coupling element later on using optionally additionally security elements. In addition, or alternatively, the handle may be mounted onto the coupling element by injection molding and the neck portion may be mounted to the coupling element later on using optionally additionally security elements. In addition or alternatively, the connection between the neck portion and the handle may comprise a snap and fit connection. For example, the coupling element may be directly mounted to the neck portion, e. g. by injection molding and the connection between the coupling element and the handle is formed via a snap and fit connection. Alternatively, the coupling element may be directly mounted to the handle, e. g. by injection molding and the connection between the coupling element and the neck portion is formed via a snap and fit. Alternatively, the connection between the coupling element and the neck portion and the handle is formed by a snap and fit connection.

The separate manufacturing results in high flexibility in the manufacturing process. That means different toothbrush elements can be produced first and combined later to form individually designed toothbrushes. For example, several handle variants can be produced which can be mounted to neck portions comprising several brush heads providing different cleaning element fields. Producing a toothbrush by combining several parts may be advantageous regarding the flexibility and the production time. For example different handles can alternatively be combined with other oral care implements, such as interdental brushes, toothpickers, floss holders, tongue cleaners or oral cavity mirrors. Thus, the toothbrush as described herein may be described as a toothbrush system which is highly flexible.

In addition, the manufacturing is very time and cost effective. Due to the combination of the different parts, all parts are smaller and shorter, so that the dimension of the molding machines is smaller. In addition, the cycle time is shorter compared to forming a toothbrush in one injection step, due to shorter injection and cooling times.

The one-time and inseparable connection between the neck and the handle may be formed by the manufacturer or by the consumer. For example, the last step of producing the toothbrush as disclosed herein may be to connect the head together with the neck with the handle at the manufacturing site. Alternatively, the head together with the neck and the handle are provided as a kit. If the head together with the neck and the handle are provided as a kit the consumers connect the two parts of the toothbrush in order to form the one-time and inseparable connection. In accordance with one aspect there is also provided a method of connecting the head together with the neck and the handle. The method comprising, providing the head together with the neck, wherein the neck comprising the coupling end providing the coupling element, providing the handle, wherein the handle comprises the receiving end providing the receiving element and combining the coupling end and the receiving end.

In the following, a detailed description of several example embodiments will be given. It is noted that all features described in the present disclosure, whether they are disclosed in the previous description of more general embodiments or in the following description of example embodiments, even though they may be described in the context of a particular embodiment, are of course meant to be disclosed as individual features that can be combined with all other disclosed features as long as this would not contradict the gist and scope of the present disclosure. In particular, all features disclosed for either one of the toothbrush or the method to produce such toothbrush may also be applied to the other one, if applicable.

FIG. 1A shows an example of a toothbrush 10 comprising a head 12, a handle 16 and a neck portion 14 being connected to the head 12. The head 12 comprises one or more cleaning elements 30 having first ends 31 which are mounted to the head 12 and second ends 32 which protrude from the surface of the head 12. The second ends 32 are intended to clean the teeth during use of the toothbrush 10. The neck portion 14 comprises a coupling end 15 being connectable to the handle 16. The coupling end 15 of the neck portion 14 further comprises a coupling element 20 which protrudes from the coupling end 15 of the neck portion 14. The handle 16 comprises a receiving end 17 comprising a receiving element 18 suitable to receive the coupling element 20. By mounting the coupling element 20 connected to the neck portion 14 into the receiving element 18 of the handle 16 an irreversible connection is formed between the neck portion 14 and the handle 16 so that the toothbrush 10 cannot be separated again into several parts without destroying the neck portion 14, the handle 16 and/or the coupling element 20 irreversibly.

The coupling element 20 may be a conically shaped body comprising a first end 21 protruding into the neck portion 14 and a second end 22 protruding into the handle 16. The coupling element 20 comprises a diameter D1. The diameter D1 may be smaller to the diameter B of the toothbrush 10 at the connection between the neck portion 14 and the handle 16. In addition or alternatively, the diameter D1 of the coupling element 20 may be constant or it may decrease towards the ends 21, 22 of the coupling element 20.

Figure 1B:
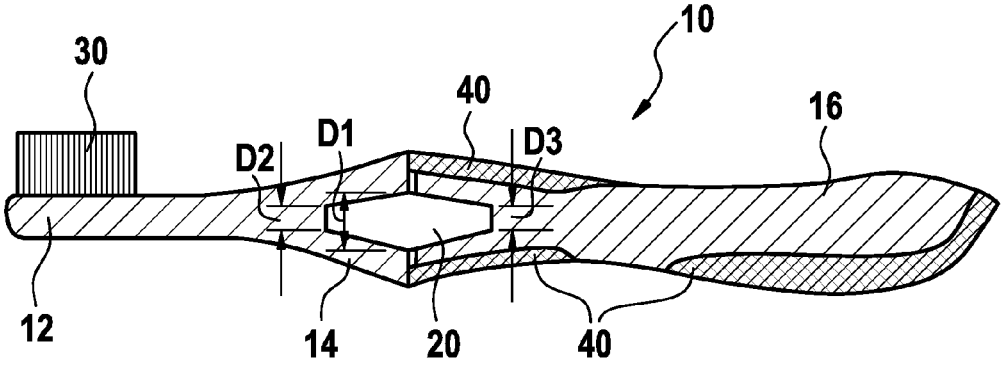
FIG. 1B shows a toothbrush 10 as shown in FIG. 1A, wherein the handle 16 comprises elastomeric elements 40 at the outline.

All features disclosed in FIG. 1A, whether described individually or in combination are also applicable to the toothbrush 10 shown in FIG. 1B. Features that are in common with the toothbrush 10 shown in FIG. 1A are designated with the same reference numerals and are not described in detail again. The handle 16 shown in FIG. 1B comprises elastomeric elements 40 at the outline. These elastomeric elements 40 may be design elements in order to improve the optical appearance and/or may be functional elements improving for example the haptic of the handle. The functional elements may improve the overall haptic of the handle or may provide grapping areas for the fingers.

Figure 2A:
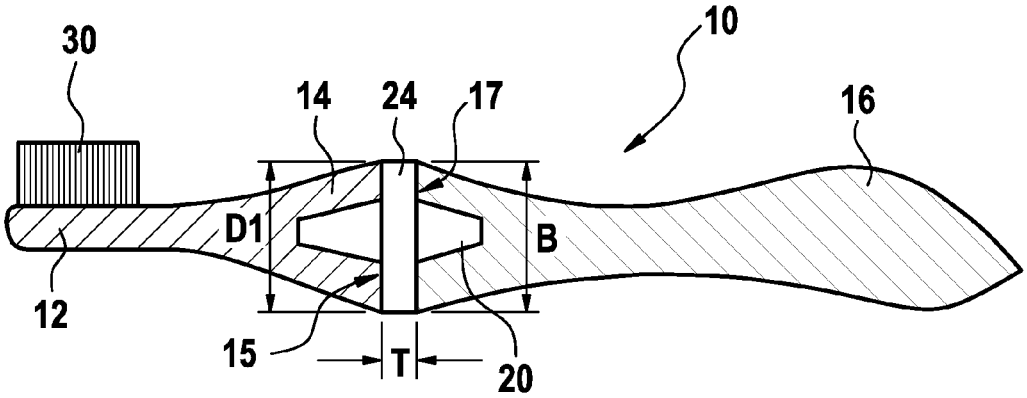
FIG. 2A shows another example of a toothbrush 10, wherein the coupling element 20 comprises a circumferential elevation 24 and wherein the diameter D1 of the circumferential elevation 24 is identical to the diameter B at the contact surface of the neck portion 14 and the handle 16.

FIG. 2 shows another example of a toothbrush 10, wherein the coupling element 20 comprises a circumferential elevation 24. All features disclosed in FIG. 1, whether described individually or in combination are also applicable to the toothbrush 10 shown in FIG. 2. Features that are in common with the toothbrush 10 shown in FIG. 1 are designated with the same reference numerals and are not described in detail again. The circumferential elevation 24 represents the central portion of the coupling element 20. The diameter D1 of the circumferential elevation 24 may be identical to the diameter B of the coupling end 15 of the neck portion 14 and the receiving end 17 of the handle 16 (s. FIG. 2A). Thus, the circumferential elevation 24 is visible at the outline of the toothbrush 10 and may be used as a design element. The thickness T of the circumferential elevation may be for example 2 mm. The circumferential elevation 24 may be arranged perpendicular or in an angle to the longitudinal axis of the toothbrush 10.

Figure 2B:
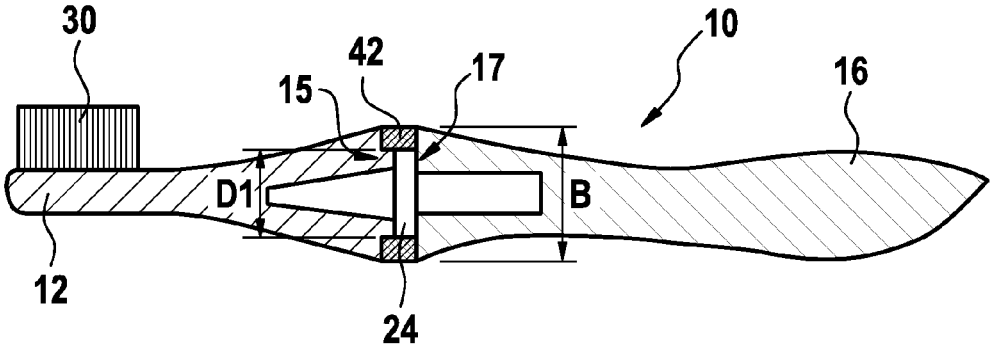
FIG. 2B shows another example of a toothbrush 10, wherein the coupling element 20 comprises a circumferential elevation 24 and wherein the diameter D1 of the circumferential elevation 24 is smaller than the diameter B at the contact surface of the neck portion 14 and the handle 16.

Alternatively, the diameter D1 of the circumferential elevation 24 may smaller than the diameter B of the coupling end 15 of the neck portion 14 and the receiving end 17 of the handle 16 (s. FIG. 2B). Thus, the circumferential elevation 24 is invisibly hidden in the neck portion 14 and the handle 16. The coupling end 15 and the receiving end 17 may show a common contact surface (not shown) or a gap may be present between the ends 15, 17 which may be filled with a sealing material 42. Said sealing material 42 may be a hard plastic material, an elastomeric material, a resin or any other material suitable to seal.

FIG. 3 shows additional examples of a toothbrush 10 comprising a coupling element 20. All features disclosed in FIG. 1 or 2, whether described individually or in combination are also applicable to the toothbrushes 10 shown in FIG. 3. Features that are in common with the toothbrush 10 shown in FIG. 1 or 2 are designated with the same reference numerals and are not described in detail again. FIG. 3A shows a toothbrush 10 comprising a coupling element 20 having a visible circumferential elevation 24. The diameter D1 of the circumferential elevation 24 is constant. The diameter D1 of the circumferential elevation 24 is bigger than the diameter D2 of the first end 21 and the diameter D3 of the second end 22 of the coupling element 20. The diameter D2 is mainly constant from the first end 21 to the circumferential elevation 24 and the diameter D3 is mainly constant from the second end 22 to the circumferential elevation 24. The diameters D2 and D3 may be identical or different compared to each other. The coupling element 20 may comprise one or more security elements 26. Said security elements 26 may be located between the first end 21 of the coupling element 20 and the circumferential elevation 24 and/or the second end 22 and the circumferential elevation 24. The security elements 26 may be protrusions protruding from the coupling element 20 which are fixed in the neck portion 14 and/or the handle 16.

Figure 3A:
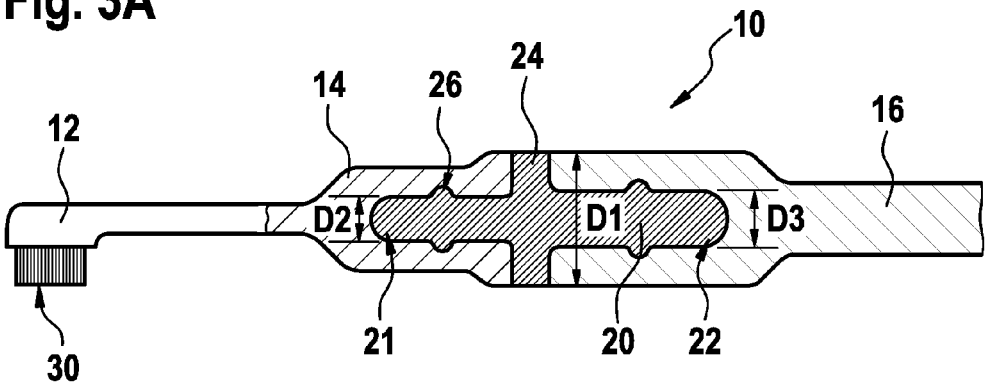
FIG. 3A shows another example of a toothbrush 10 comprising a coupling element 20 having a visible circumferential elevation 24, wherein the coupling element 20 comprises one or more security elements 26.
Figure 3B:
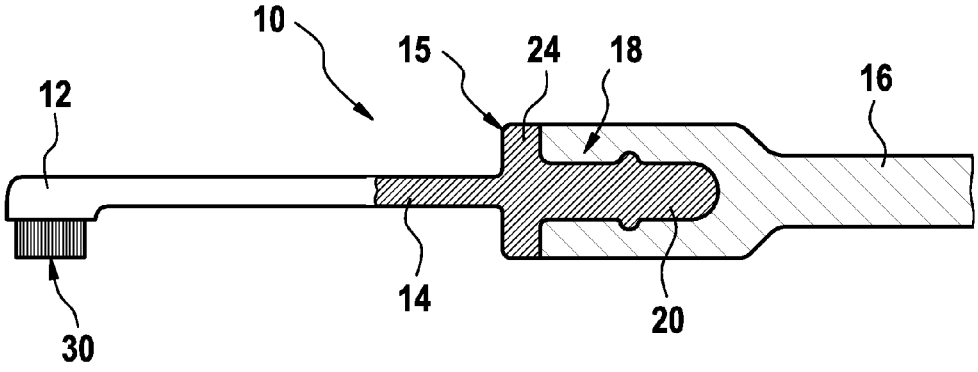
FIG. 3B shows another example of a toothbrush 10, wherein the coupling element 20 forms an inseparable part of the neck portion 14.

FIG. 3B shows a toothbrush 10, wherein the coupling element 20 forms an inseparable part of the neck portion 14. The coupling element 20 directly protrudes from the coupling end 15 of the neck portion 14 and cannot be distinguished from the neck portion 14. Thus, the circumferential elevation 24 represents also the coupling end 15 of the coupling element 20. The coupling element 20 comprises protrusions as security elements 26 in order to secure a safe and irreversible connection between the coupling element 20 and the receiving element 18 of the handle 16.

Figure 3C:
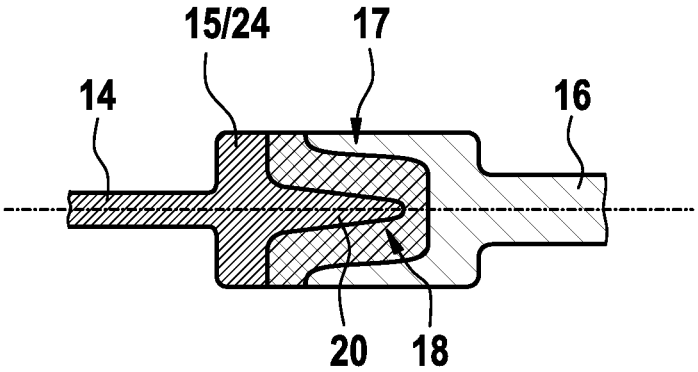
FIG. 3C shows another example of a toothbrush 10, wherein the coupling element 20 forms an inseparable part of the neck portion 14 and the receiving element 18 is formed of an elastomeric material.

FIG. 3C shows the central, namely the coupling part of another toothbrush 10, wherein the coupling element 20 forms an inseparable part of the neck portion 14. The receiving element 18 of the handle 16 is formed of a soft plastic material, such as a thermoplastic material. The receiving element 18 shows the same geometric shape than the receiving end 17 of the handle, which is formed from a hard plastic material. Receiving element 18 and receiving end 17 both comprise a cavity into which the coupling element 20 can be mounted. For example, the handle 16 and the coupling element 20 may be formed from a hard plastic material, such as polypropylene. Thereby, the cavity formed in the handle 16 is bigger than the coupling element 20. By filing the gap between the coupling element 20 and the receiving end 17 of the handle 16 with for example a thermoplastic elastomer the receiving element 18 is formed thereby irreversibly combining the neck portion 14 and the handle 16.

Figure 3D:
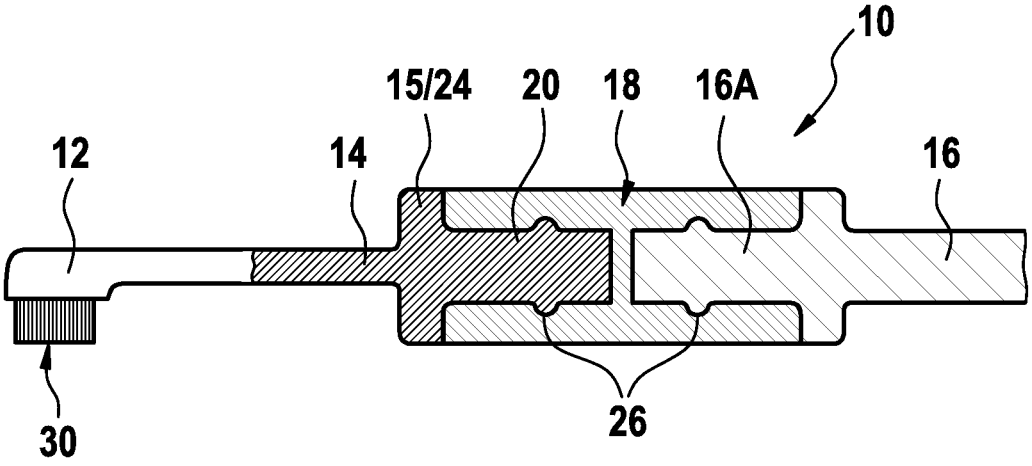
FIG. 3D shows another example of a toothbrush 10, wherein the coupling element 20 forms an inseparable part of the neck portion 14, wherein the receiving element 18 of the handle 16 is formed of two different materials.

FIG. 3D shows another toothbrush 10, wherein the coupling element 20 forms an inseparable part of the neck portion 14. The receiving end of the handle 16 is formed of two different materials. A first material forms a protrusion 16A of the handle 16 comprising security elements 26. The second material surrounds the protrusion 16A and the coupling element 20 thereby forming the receiving element 18. The second material forming the receiving element 18 may be identical or different to the first material from which the handle 16 is formed. For example, the second material may be an elastomeric material. Thereby, the receiving element 18 of the handle represents both the receiving element 18 and a grapping surface onto which the fingers can be placed during use of the toothbrush 10.

Figure 4A:
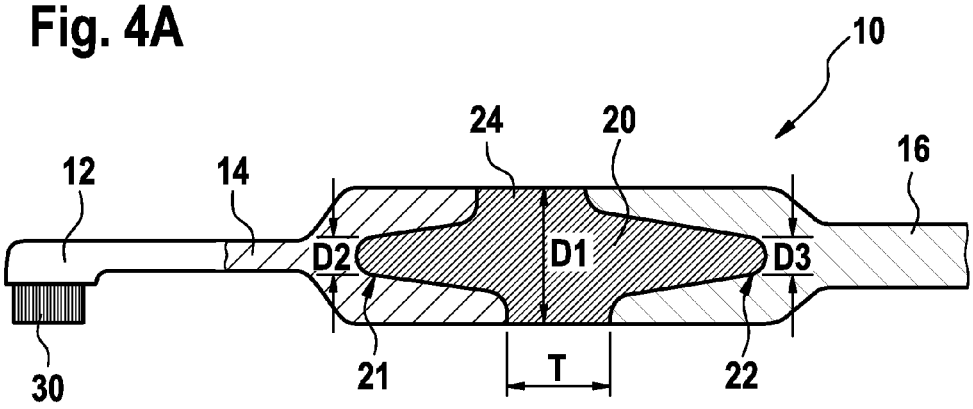
FIG. 4A shows another example of a toothbrush 10, wherein the coupling element 20 is made from a thermoplastic elastomer and forms a hinge which can be bent in the direction of a force acting on the one or more cleaning elements 30 during brushing.

FIG. 4 shows additional examples of a toothbrush 10 comprising a coupling element 20. All features disclosed in FIG. 1, 2 or 3, whether described individually or in combination are also applicable to the toothbrushes 10 shown in FIG. 4. Features that are in common with the toothbrush 10 shown in FIG. 1, 2 or 3 are designated with the same reference numerals and are not described in detail again. The coupling element 20 comprises a visible circumferential elevation 24 having a constant diameter D1. The diameter D1 of the circumferential elevation 24 is bigger than the diameter D2 of the first end 21 and the diameter D3 of the second end 22 of the coupling element 20. The diameter D2 increases from the first end 21 towards the circumferential elevation 24 and the diameter D3 increases from the second end 22 towards the circumferential elevation 24, wherein the diameters of the coupling element 20 adjacent to the circumferential elevation 24 are smaller than D1. The diameters D2 and D3 may be identical or different compared to each other. In addition to its coupling function the coupling element 20 also provides a hinge function. For example, the thickness T of the circumferential elevation 24 may be increased so that the brush can be bent at the circumferential elevation 24. The maximal thickness T of the circumferential elevation may be twice the diameter D1. Preferred thicknesses T are in the range of about 2 to 15 mm. The circumferential elevation 24 may be round or may be a rectangular body. If the circumferential elevation has a rectangular shape, the smaller moment of inertia is parallel to the force acting in the direction of the one or more cleaning elements 30. A coupling element 20 acting as a hinge may be made from a thermoplastic elastomer having a Shore A hardness of 80.

Figure 4B:
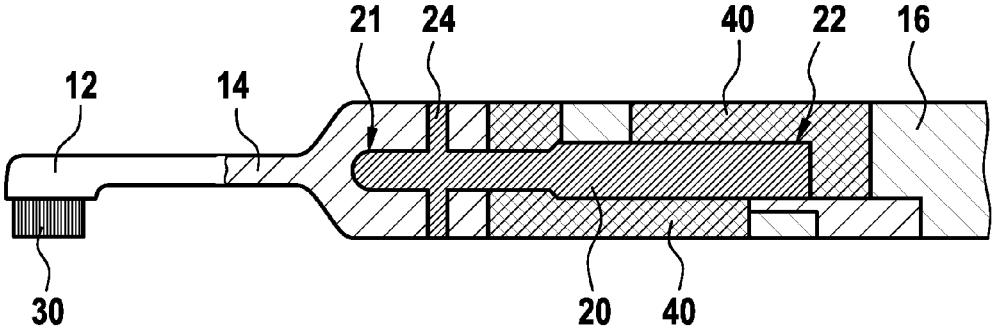
FIG. 4B shows another example of a toothbrush 10, wherein the coupling element 20 is formed from a hard plastic material and the handle 16 is formed at least partially from a thermoplastic elastomer so that the coupling element 20 functions as a hinge.

FIG. 4B shows another example of a toothbrush 10 having a coupling element 20 showing a hinge function. The coupling element 20 comprises a circumferential elevation 24, a first end 21 and a second end 22. The diameter D2 and D3 of the first end 21 and the second end 22 of the coupling element 20 is significantly smaller than the diameter D1 of the circumferential elevation 24.

Thus, the geometry of the coupling element 20 can be described as a long pin having a circumferential elevation 24. The second end 22 may be located farther away from the circumferential elevation 24 than the first end 21. Thus, the coupling element 20 is asymmetric. The coupling element 20 may be manufactured from a hard plastic material, for example the coupling element 20 may be manufactured from reinforced polypropylene or polyoxymethylene. The handle surrounding the second end 22 of the coupling element 20 may be formed at least partially from a soft plastic material 40, for example the part of the handle 16 surrounding the second end 22 of the coupling element 20 may be formed from a thermoplastic elastomer. In particular, the handle 16 may be formed partially from a thermoplastic elastomer. Using said material combination, the toothbrush 10 shown in FIG. 4B shows a force compensation mechanism. A force applied to the one or more cleaning elements 30 may be transported via the coupling element 20 into the elastomeric part 40 of the handle 16. Thereby the elastomeric part 40 of the handle 16 is deformed. Said deformation compensates the force applied to the brush head 12 at least partially.

In addition or alternatively to compensating forces, the coupling element 20 may show another function. A sensor 44 alerting the user by a signal may be included in the handle 16. The sensor 44 may be introduced in the handle 16 so that the coupling element 20 will activate the sensor 44, if too much force is applied to the one or more cleaning elements 30. For example, the sensor may be incorporated into the elastomeric part 40 of the handle 16. Thus, the sensor 44 will be activated, if the coupling element 20 compresses the elastomeric part 40 of the handle 16. The signal may be a light signal, a tone signal or a vibration.

Figure 4C:
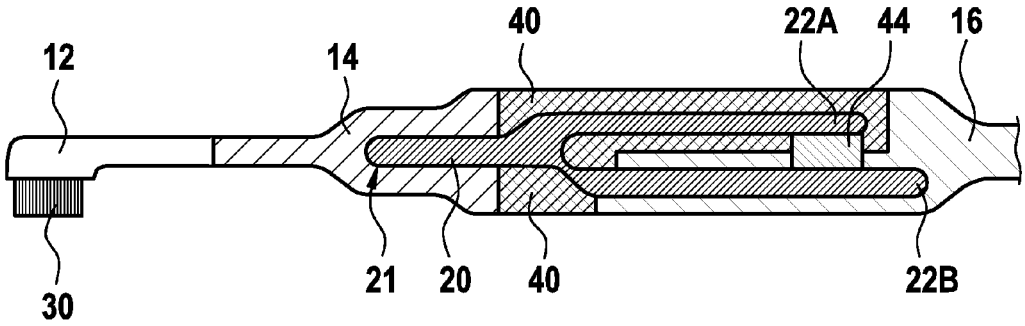

FIG. 4C shows another example toothbrush 10 having a coupling element 20 which works as a hinge and a sensor 44 activator. The coupling element 20 comprises a first end 21 and a U-shaped second end 22 having two arms 22A and 22B. Thus, the coupling element 20 shown in FIG. 4C is shaped like a tuning fork. The handle 16 into which the second end 22 of the coupling element 20 is incorporated in may be formed of hard plastic and of soft plastic material. For example, one arm 22A of the second end 22 may be surrounded by hard plastic material and one arm 22B of the second end 22 may be surrounded by soft plastic material, such as a thermoplastic elastomer 40. A sensor 44 may be placed between the two arms 22A, 22B. If force is applied to the brush head 12, the second arm 22B will be moved in the direction of the first arm 22A, thereby compressing the elastomeric part 40 of the handle 16 and activating the sensor 44. The relative movement of the second arm 22B towards the first arm 22A will be increased, if the first arm 22A which is stabilized by the hard plastic material of the handle 16 comprises an integral hinge.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A toothbrush comprising a head comprising one or more cleaning elements, a handle, a neck portion being connected to the head and a coupling element, wherein the coupling element has a first end protruding into the neck portion and a second end protruding into the handle, wherein the neck portion comprises a coupling end that is one-time and irreversibly connectable to the handle and irreversibly mounted onto the coupling element first end, wherein a part of the coupling element protrudes from the neck portion, wherein the handle comprises a receiving end comprising a receiving element structured and configured to receive the second end of the coupling element that protrudes from the neck portion and wherein the neck portion and the handle are arranged irreversibly onto the coupling element such that the neck portion and the handle cannot be separated from one another and from the coupling element without the toothbrush being destroyed;

wherein the coupling element comprises a circumferential elevation located between the coupling end of the neck portion and the receiving end of the handle;

wherein the circumferential elevation comprises a part of an outer surface of the toothbrush or is covered by the coupling end and the receiving end after the neck portion and the handle have been connected; and wherein a diameter of the first end of the coupling element disposed in at least one of the head and the neck portion and a diameter of the second end of the coupling element disposed in the handle is smaller than a diameter of the circumferential elevation.

2. The toothbrush according to claim 1, wherein a material of the coupling element has an E-modulus that is higher than those of a material of the head, a material of the neck portion, a material of the handle, or a material of any combination thereof.

3. The toothbrush according to claim 2, wherein the coupling element comprises a hard plastic material.

4. The toothbrush according to claim 3, wherein the hard plastic material is selected from the group consisting of polyoxymethylene, polypropylene, polyethylene, polyethylene terephthalate and any mixture thereof.

5. The toothbrush according to claim 3, wherein the receiving element comprises a thermoplastic elastomer.

6. The toothbrush according to claim 1, wherein the coupling element comprises a thermoplastic elastomer.

7. The toothbrush according to claim 6, wherein the thermoplastic elastomer has a Shore-A hardness in the range of from about 60 to about 110.

8. The toothbrush according to claim 6, wherein the thermoplastic elastomer has a Shore-A hardness in the range of from about 70 to about 100.

9. The toothbrush according to claim 6, wherein the thermoplastic elastomer has a Shore-A hardness in the range of from about 75 to about 90.

10. The toothbrush according to claim 6, wherein the receiving element comprises a thermoplastic elastomer.

11. The toothbrush according to claim 1, wherein the coupling element is cylindrically or conically shaped.

12. The toothbrush according to claim 1, wherein the coupling element comprises at least one security element.

13. The toothbrush according to claim 12, wherein the at least one security element is selected from the group consisting of an engagement hook, a protrusion, an undercut, a snap-fit connection, and any combinations thereof.

14. The toothbrush according to claim 1, wherein the coupling element comprises at least one security element.

15. The toothbrush according to claim 14, wherein the at least one security element is selected from the group consisting of an engagement hook, a protrusion, an undercut, a snap-fit connection, and any combinations thereof.

16. The toothbrush according to claim 12, wherein the part of the handle surrounding the second end of the coupling element comprises a thermoplastic elastomer.

17. The toothbrush according to claim 1, wherein at least one of a surface of the head portion, a surface of the neck portion, and a surface of the handle portion comprises a finish.

18. The toothbrush according to claim 17, wherein the finish is applied by a finishing technique selected from the group consisting of galvanization, polishing, roughening, applying a coating, applying a printing, applying a varnish, and any combination thereof.

19. The toothbrush according to claim 1, wherein the neck portion is constructed by injection molding wherein the coupling element is over-molded.

20. The toothbrush according to claim 1, wherein the coupling element and the handle comprise a snap-and-fit connection.

* * * * *